US009630052B2

(12) United States Patent
Peng

(10) Patent No.: US 9,630,052 B2
(45) Date of Patent: Apr. 25, 2017

(54) ELLIPTIC-ORBIT TREADMILL

(71) Applicant: MARIO CONTENTI DESIGNS CO., LTD., Taichung (TW)

(72) Inventor: Jing-Yuan Peng, Taipei (TW)

(73) Assignee: MARIO CONTENTI DESIGNS CO., LTD., Taichung (TW)

( * ) Notice: Subject to any disclaimer, the term of this patent is extended or adjusted under 35 U.S.C. 154(b) by 0 days.

(21) Appl. No.: 15/082,202

(22) Filed: Mar. 28, 2016

(65) Prior Publication Data

US 2017/0014676 A1 Jan. 19, 2017

(30) Foreign Application Priority Data

Jul. 17, 2015 (TW) ..... 104211539 U

(51) Int. Cl.

| | |
|---|---|
| ***A63B 22/02*** | (2006.01) |
| ***A63B 22/00*** | (2006.01) |
| ***A63B 71/00*** | (2006.01) |
| ***A63B 22/06*** | (2006.01) |
| ***A63B 21/22*** | (2006.01) |
| ***A63B 23/035*** | (2006.01) |

(52) U.S. Cl.

CPC ..... *A63B 22/0664* (2013.01); *A63B 21/225* (2013.01); *A63B 23/03591* (2013.01); *A63B 2022/0676* (2013.01)

(58) Field of Classification Search

CPC ..... A63B 22/04; A63B 23/10; A63B 23/0405; A63B 23/03525; A63B 22/06–22/0694; A63B 23/03591; A63B 21/225

USPC ..... 482/51–54

See application file for complete search history.

(56) References Cited

U.S. PATENT DOCUMENTS

| | | | | |
|---|---|---|---|---|
| 5,290,211 | A * | 3/1994 | Stearns | A63B 21/00178 482/51 |
| 5,496,235 | A * | 3/1996 | Stevens | A63B 21/015 434/255 |
| 5,792,028 | A * | 8/1998 | Jarvie | A63B 22/001 482/51 |
| 5,876,307 | A * | 3/1999 | Stearns | A63B 22/001 482/51 |
| 6,416,442 | B1 * | 7/2002 | Stearns | A63B 22/001 482/52 |
| 6,648,801 | B2 * | 11/2003 | Stearns | A63B 22/001 482/52 |

(Continued)

*Primary Examiner* — Stephen Crow
*Assistant Examiner* — Garrett Atkinson
(74) *Attorney, Agent, or Firm* — Egbert Law Offices, PLLC

(57) ABSTRACT

An elliptic-orbit treadmill has a front-end drive portion and a middle drive portion configured on the front end of the pedal, the middle drive portion being pivotally linked to the bottom end of the handle bar on the same side. Each transmission bar set includes a transverse connecting rod and a vertical connecting rod pivotally connected to each other in an elbow style, the rear end of the transverse connecting rod being pivotally connected to the middle section of the handle bar on the same side, while the bottom end of the vertical connecting rod being pivotally connected to the front-end drive portion of the pedal on the same side. The crank provided on the transverse driven shaft at the center of the flywheel is pivotally connected to the middle section of the transverse connecting rod provided on the transmission bar set on the same side.

3 Claims, 6 Drawing Sheets

(56) References Cited

U.S. PATENT DOCUMENTS

| | | | | |
|---|---|---|---|---|
| 7,137,927 | B2 * | 11/2006 | Maresh | A63B 22/0007 482/52 |
| 7,520,839 | B2 * | 4/2009 | Rodgers, Jr. | A63B 22/001 482/51 |
| 7,556,591 | B2 * | 7/2009 | Chuang | A63B 22/001 482/51 |
| 7,651,445 | B1 * | 1/2010 | Chen | A63B 22/001 482/51 |
| 7,828,698 | B2 * | 11/2010 | Rodgers, Jr. | A63B 22/001 482/51 |
| 8,029,416 | B2 * | 10/2011 | Eschenbach | A63B 22/001 482/52 |
| 8,454,478 | B2 * | 6/2013 | Giannelli | A63B 22/001 482/51 |
| 9,050,498 | B2 * | 6/2015 | Lu | A63B 21/154 |
| 2001/0004623 | A1 * | 6/2001 | Miller | A63B 22/001 482/52 |
| 2001/0051562 | A1 * | 12/2001 | Stearns | A63B 22/001 482/51 |
| 2008/0287265 | A1 * | 11/2008 | Giannelli | A63B 22/001 482/52 |

* cited by examiner

ELLIPTIC-ORBIT TREADMILL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to sport and fitness equipment, and more particularly to an innovative structural design of an elliptic-orbit treadmill.

2. Description of Related Art Including Information Disclosed Under 37 CFR 1.97 and 37 CFR 1.98.

Among the products of currently existing sport and fitness equipment, a very common structural design is an elliptic-orbit treadmill. It mainly features a movement track similar to an elliptic orbit when it is trodden and in motion. Such a motion is quite close to the motion status of the human feet when a person is naturally walking.

Elliptic-orbit treadmills seen in the current market have various structural designs. However, based on the design of the pedal portion, they can be roughly classified into two styles: one with a floor support structure at the bottom, and the other is of a suspension style without a floor support structure. The present invention particularly deals with the improvement of the latter structural design.

The above-mentioned elliptic-orbit treadmill with a suspension-style pedal portion without a floor support structure at the bottom simplifies the bottom structure because it omits the floor support structure at the bottom of the pedal. However, the suspension and motion transmission mechanisms above the pedal portion often have the problem of too many connection and frame components and complicated assembly and connection styles. These lead to considerably increased cost of product materials, processing, assembly, and storage etc, and a relatively higher failure rate in future usage. Hence, it is necessary to make a breakthrough in its design through some improvements.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The "elliptic-orbit treadmill" disclosed in the present invention mainly has the following features: a front-end drive portion and a middle drive portion are configured on the front end of the pedal, the middle drive portion being pivotally linked to the bottom end of the handle bar on the same side; each transmission bar set includes a transverse connecting rod and a vertical connecting rod pivotally connected to each other in an elbow style, the rear end of the transverse connecting rod being pivotally connected to the middle section of the handle bar on the same side, while the bottom end of the vertical connecting rod being pivotally connected to the front-end drive portion of the pedal on the same side; furthermore, the crank provided on the transverse driven shaft at the center of the flywheel is pivotally connected to the middle section of the transverse connecting rod provided on the transmission bar set on the same side. Based on such innovative and unique structural designs, the present invention gains an advantage over the existing structures in the "prior art". The motion transmission structure of the present invention is an integration of a four-link mechanism with a simple construction (i.e., the structure formed by linkage between the handle bar, the transmission bar set, and the pedal) and a crank mechanism (i.e., the cranks provided on the two sides of the transverse driven shaft of the flywheel), and its crank is directly linked to the transverse connecting rod of the transmission bar set. In this way, the transmission is very simple The components of transmission structure of the elliptic-orbit treadmill can be substantially reduced. And consequently, the material, production and assembly costs can be reduced substantially, and the product will have lower failure rates and better operational performance. Hence, the present invention makes a practical advancement and can generate good industrial and economic benefits.

DETAILED DESCRIPTION OF THE INVENTION

Figure 1:
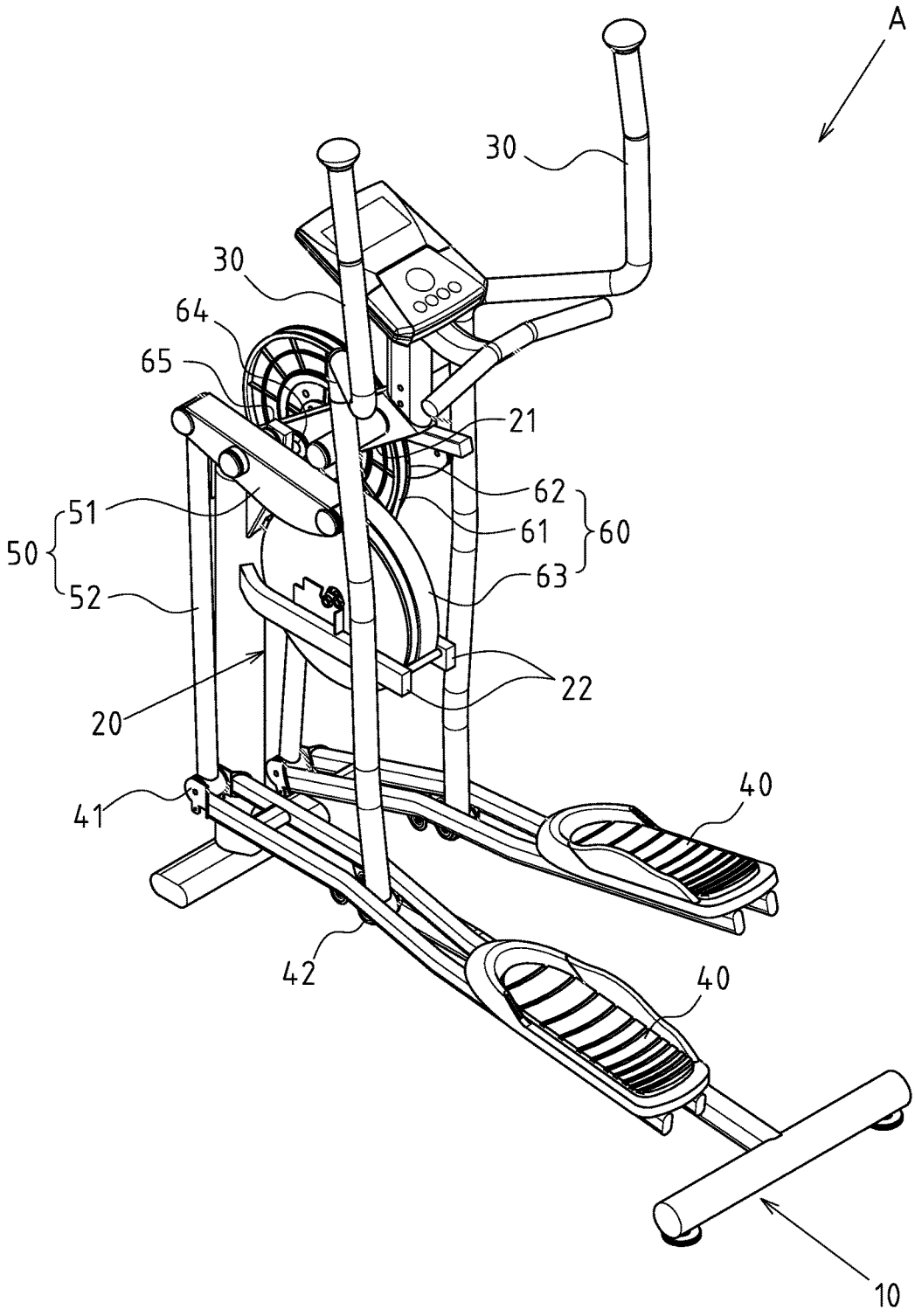
FIG. 1 is an assembled perspective of a preferred embodiment of the structure of the present invention.

A preferred embodiment of the present invention of an elliptic-orbit treadmill is disclosed in FIGS. 1-6. While such an embodiment is for description purposes only, the scope of patent protection as applied is not limited to such a structure. Said elliptic-orbit treadmill A comprises a base 10, a front standing frame 20, two handle bars 30 provided on the left and right sides, two pedals 40, two transmission bar sets 50 and a damping mechanism 60. Said front standing frame 20 is vertically configured on the front end of the base 10; said damping mechanism 60 is provided at a specific height of the front standing frame 20, including a flywheel 62 and a resistance regulation wheel 63 that are connected to each other through a drive component 61, wherein the center of said flywheel 62 has a transverse driven shaft 64, and the left and right side ends of the transverse driven shaft 64 are configured with two cranks 65 with opposite bending directions. The upper portions of the two handle bars 30 are pivotally connected to the front standing frame 20 in a pair at a specific height, and in a state that they can swing vertically. Said two pedals 40 are suspended in a pair above the base 10 at spaced heights, the front end of each pedal 40 is configured with a front-end drive portion 41 and a middle drive portion 42 spaced at an interval, wherein said middle drive portion 42 is pivotally connected to the bottom end of the handle bar 30 on the same side; each transmission bar set 50 includes a transverse connecting rod 51 and a vertical connecting rod 52 that are pivotally connected to each other in an elbow style, wherein the rear end of said transverse connecting rod 51 is pivotally connected to the middle portion of the handle bar 30 on the same side, the bottom end of said vertical connecting rod 52 is pivotally connected to the front-end drive portion 41 of the pedal 40 on the same side. Furthermore, the crank 65 configured on the transverse driven shaft 64 at the center of the flywheel 62 is pivotally connected to the middle portion of the transverse connecting rod 51 provided on the transmission bar set 50 on the same side.

In particular, at the height of the front standing frame 20 for configuration of the damping mechanism 60, there is a configuration of a tilted frame section 21 that tilts toward the backside, so that the flywheel 62 of the damping mechanism 60 can be assembled on the tilted frame section 21, and the front standing frame 20 below the tilted frame section 21 at an interval is transversely configured with a lower support frame 22 that protrudes backward, so that the resistance regulation wheel 63 can be assembled on the lower support frame 22. In this way, the flywheel 62 and resistance regulation wheel 63 are in an up-down configuration.

Figure 4:
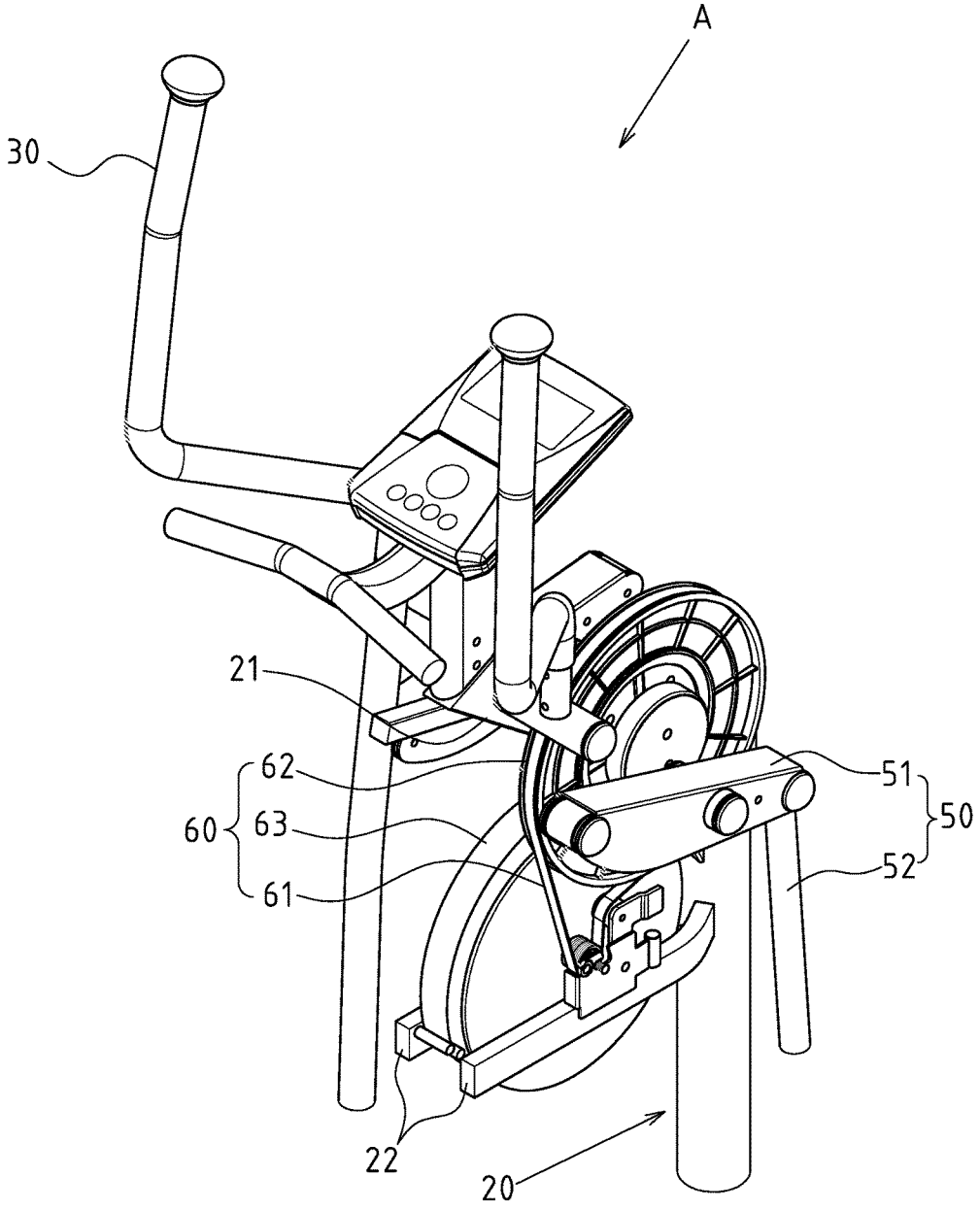
FIG. 4 is another perspective view of a partial structure of the present invention.
Figure 5:
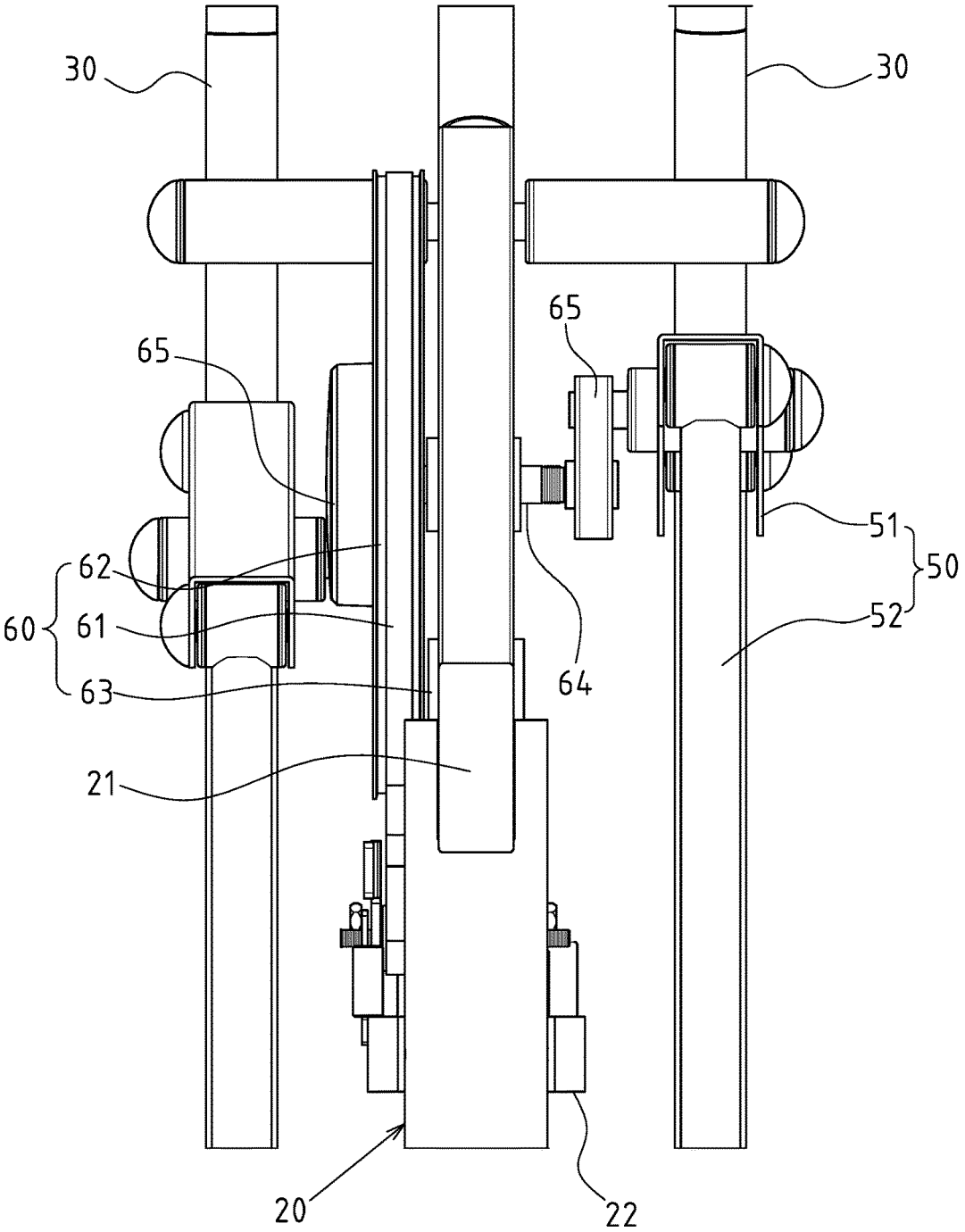
FIG. 5 is a plane view of a partial structure of the present invention.

In particular, in the damping mechanism 60, the drive component 61 to drive the flywheel 62 and resistance regulation wheel 63 can be a belt (see FIG. 4 for details).

Figure 2:
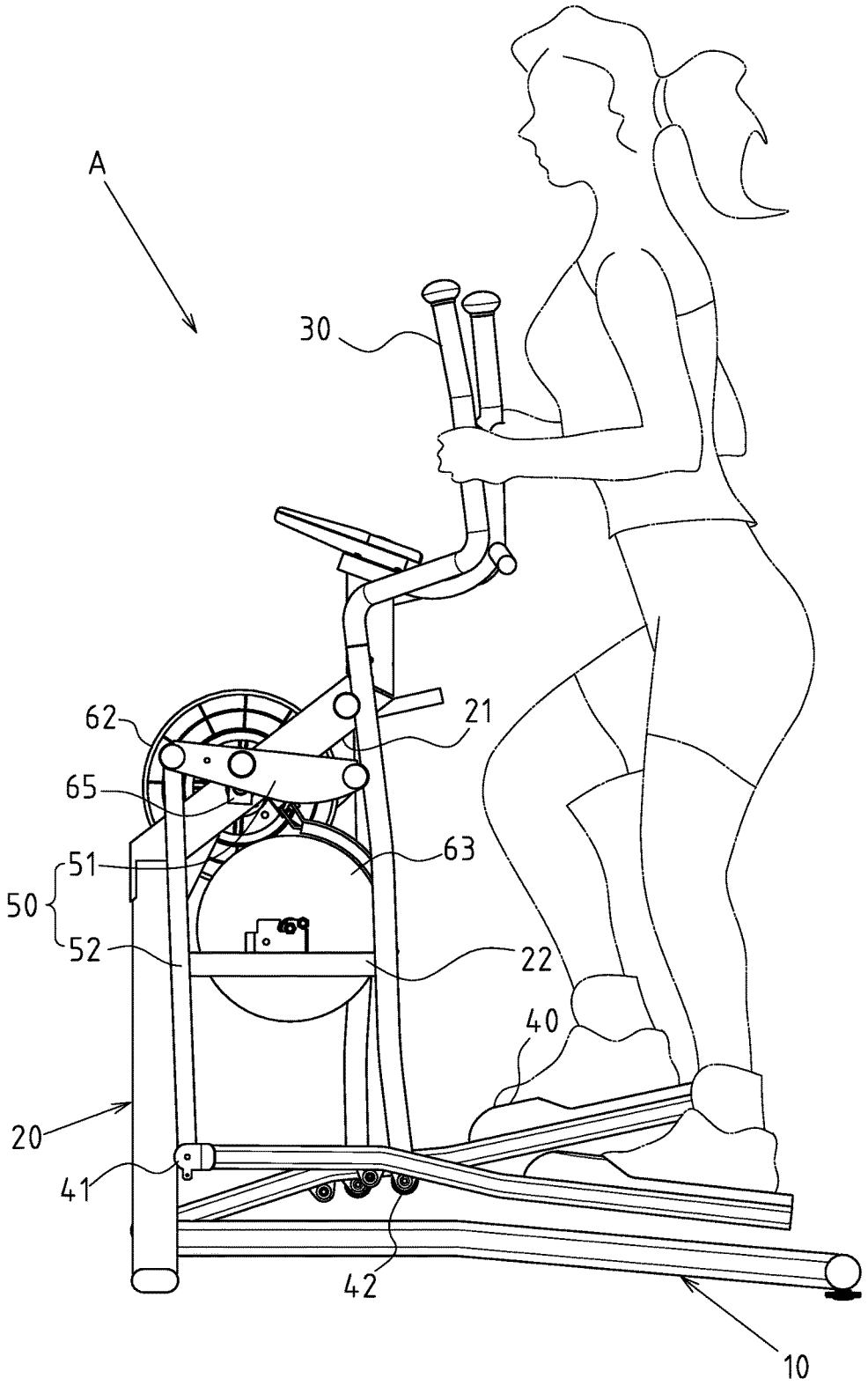
FIG. 2 is a plane side view of a preferred embodiment of the structure of the present invention.
Figure 3:
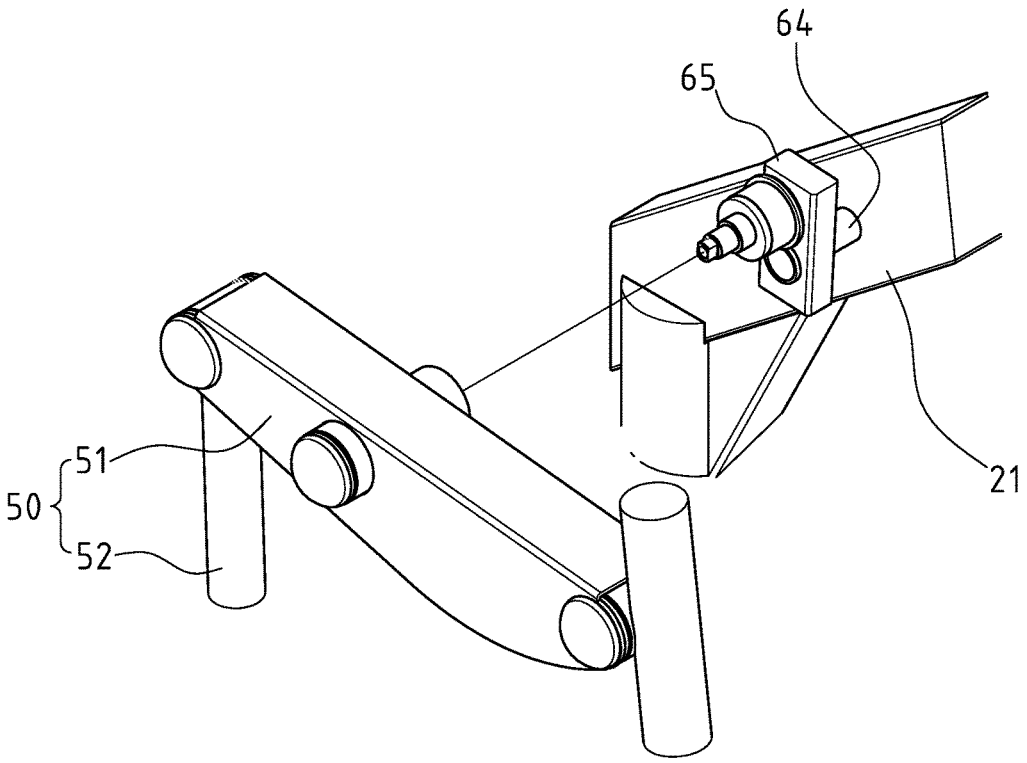
FIG. 3 is perspective view of a partial structure of the present invention.
Figure 6:
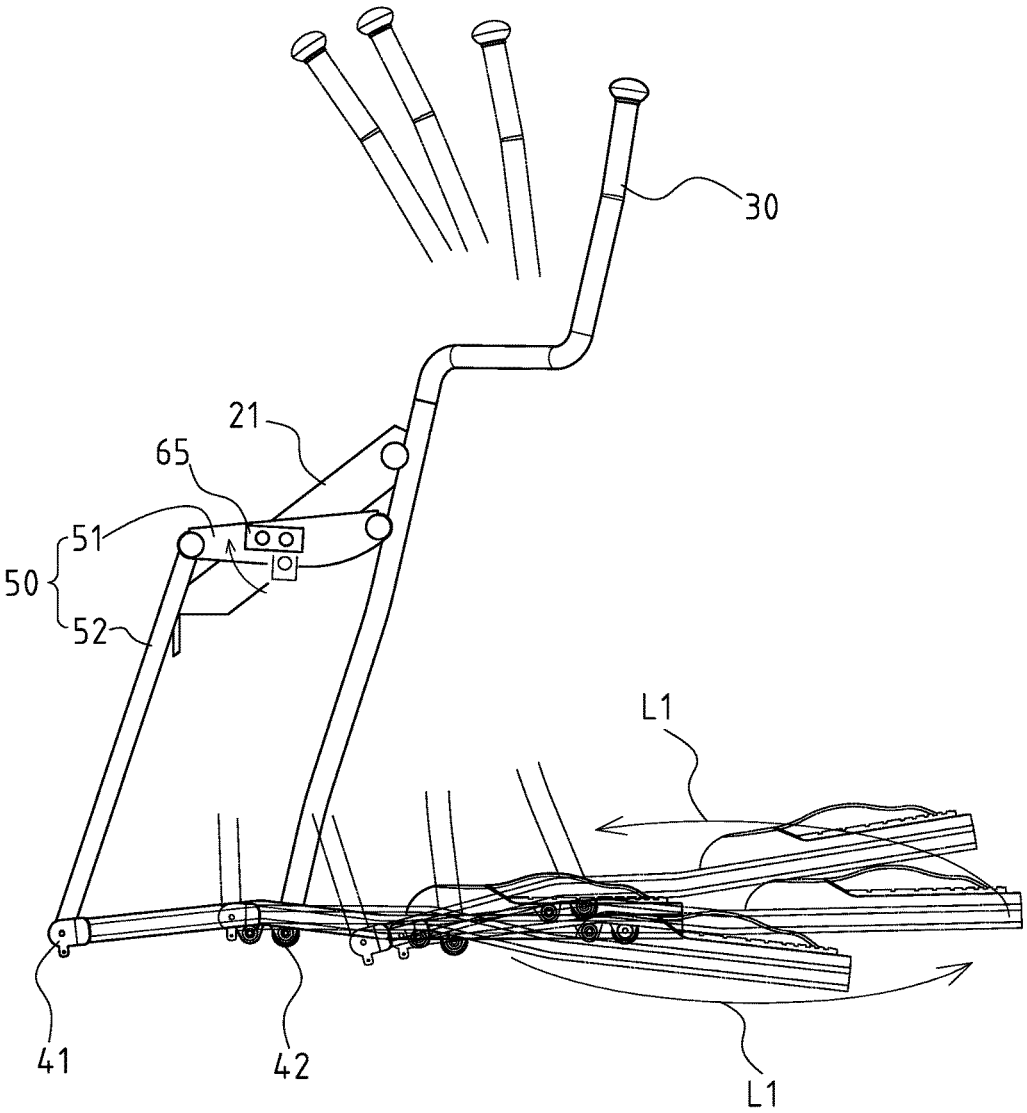
FIG. 6 is an operational view of the pedal of the present invention.

Based on the design constituted by the above-mentioned structure, the usage and operational condition of the present invention is as described below: in the structure of the elliptic-orbit treadmill A disclosed in the present invention, the components including the handle bar 30, the transverse connecting rod 51 and the vertical connecting rod 52 of the transmission bar set 50, the front-end drive portion 41 and the middle drive portion 42 of the pedal 40 form a four-link mechanism. In this way, the two pedals 40 are supported and suspended above the base 10 at spaced heights; the working status of the structure is shown in FIGS. 2 and 6. When the two pedals 40 are trodden, there are two rotational support point above them: one is the pivotal connecting portion between the upper section of the handle bar 30 and the front standing frame 20 (this portion is a fixed rotational support point to let the handle bar 30 and the two pedals 40 to swing back and forth); the other is the pivotal connection portion between the two cranks 65 and the middle section of the transverse connecting rod 51 provided on the transmission bar set 50 (this portion is a rotational support point with a circular movement path; the function of this portion is to let the front end of the transverse connecting rod 51 provided on the transmission bar set 50 swing up and down when the above-mentioned handle bar 30 swings back and forth along with the two pedals 40, and subsequently drive the bottom end of the vertical connecting rod 52 provided on the transmission bar set 50 to have an up-and-down motion. Thus, the pedal 40 will swing up and down with the middle drive portion 42 as a fulcrum (note: because the front-end drive portion 41 will go up and down along with the bottom end of the vertical connecting rod 52). Hence, when the pedal 40 swings back and forth, it will simultaneously have an up-and-down motion, and form a motion orbit similar to an elliptic cyclic path (as indicated by Arrow L1 in FIG. 6); and because the bending directions of the two cranks 65 configured on the left and right side ends of the transverse driven shaft 64 are opposite to each other, the motions of the two handle bars 30, two pedals 40 and two transmission bar sets 50 configured on the left and right sides will be contrary, i.e., while one goes forward, the other goes backward, or while one goes upward, the other goes downward (as shown in FIG. 1).

In short, the motion transmission structure of the elliptic-orbit treadmill disclosed in the present invention is an integration of a four-link mechanism (i.e., the structure formed by linkage between the handle bar 30, transmission bar set 50, and pedal 40) and a crank mechanism (i.e., the cranks 65 provided on the two sides of the transverse driven shaft 64 of the flywheel 62), and its crank 65 is directly linked to the transverse connecting rod 51 of the transmission bar set 50. In this way, the transmission is simple and direct. The space occupied by the components can be minimized, and the material, production and assembly costs can be reduced substantially.

I claim:

1. An elliptic-orbit treadmill, comprising a base, a front standing frame, two handle bars provided on the left and right sides, two pedals, two transmission bar sets and a damping mechanism; wherein, the front standing frame is vertically configured on the front end of the base, the damping mechanism is provided at a specific height of the front standing frame, including a flywheel and a resistance regulation wheel that are connected to each other through a drive component, wherein the center of the flywheel has a transverse driven shaft, and the left and right side ends of the transverse driven shaft are configured with two cranks with opposite bending directions; the upper portions of the two handle bars are connected to the front standing frame in a pair at a specific height, and in a state that they can swing vertically; the two pedals are suspended in a pair above the base at spaced heights, the front ends of the two pedals are configured with a front-end drive portion and a middle drive portion spaced at an interval, wherein the middle drive portion is pivotally connected to the bottom end of the handle bar on the same side; each transmission bar set includes a transverse connecting rod and a vertical connecting rod that are pivotally connected to each other in an elbow style, wherein the rear end of the transverse connecting rod is pivotally connected to the middle portion of the handle bar on the same side, the bottom end of the vertical connecting rod is pivotally connected to the front-end drive portion of the pedal on the same side; furthermore, the crank configured on the transverse driven shaft at the center of the flywheel is pivotally connected to the middle portion of the transverse connecting rod provided on the transmission bar set on the same side.

2. The structure defined in claim 1, wherein, at the height of the front standing frame for configuration of the damping mechanism, there is a configuration of a tilted frame section that tilts toward the backside, so that the flywheel of the damping mechanism can be assembled on the tilted frame section, and the front standing frame below the tilted frame section at an interval is transversely configured with a lower support frame that protrudes backward, so that the resistance regulation wheel can be assembled on the lower support frame; in this way, the flywheel and resistance regulation wheel are in an up-down configuration.

3. The structure defined in claim 2, wherein, in the damping mechanism, the drive component to drive the flywheel and resistance regulation wheel can be a belt.

* * * * *